United States Patent [19]

Pommer

[11] 4,082,176

[45] Apr. 4, 1978

[54] APPARATUS FOR HANDLING SNACK CHIPS

[75] Inventor: Dennis Pommer, Minneapolis, Minn.

[73] Assignee: General Mills, Inc., Minneapolis, Minn.

[21] Appl. No.: 650,408

[22] Filed: Jan. 19, 1976

[51] Int. Cl.[2] ..... B65G 47/29

[52] U.S. Cl. ..... 198/411; 198/425; 198/462; 198/539; 198/817

[58] Field of Search ..... 198/34, 35, 282, 283, 198/411, 416, 423, 462, 425, 817, 539

[56] References Cited

U.S. PATENT DOCUMENTS

| | | | |
|---|---|---|---|
| 2,650,010 | 8/1953 | Moore | 198/34 X |
| 2,759,510 | 8/1956 | Hartman | 198/34 X |
| 3,483,963 | 12/1969 | Green et al. | 198/34 |
| 3,590,977 | 7/1971 | Stanford | 198/34 |
| 3,677,391 | 7/1972 | Schaeffer | 198/35 |
| 3,811,549 | 5/1974 | Preisig | 198/462 |
| 3,978,971 | 9/1976 | Conrow et al. | 198/604 |

FOREIGN PATENT DOCUMENTS

| | | | |
|---|---|---|---|
| 1,248,126 | 9/1971 | United Kingdom | 198/34 |
| 1,075,304 | 7/1967 | United Kingdom | 198/34 |

*Primary Examiner*—Evon C. Blunk
*Assistant Examiner*—Richard K. Thomson
*Attorney, Agent, or Firm*—G. O. Enockson; L. M. Lillehaugen

[57] ABSTRACT

Apparatus is provided for handling a column of nested, uniformly shaped snack chips. The apparatus comprises a pair of parallel, spaced elongated conveying surfaces which support an imbricated column of chips and a stationary support bar positioned therebetween. A gate engages the chips causing them to rotate backwardly transferring the support of the chips from the conveying surfaces to the bar thereby eliminating frictional drag on the articles. A second gate is provided to segregate the column into two portions.

8 Claims, 6 Drawing Figures

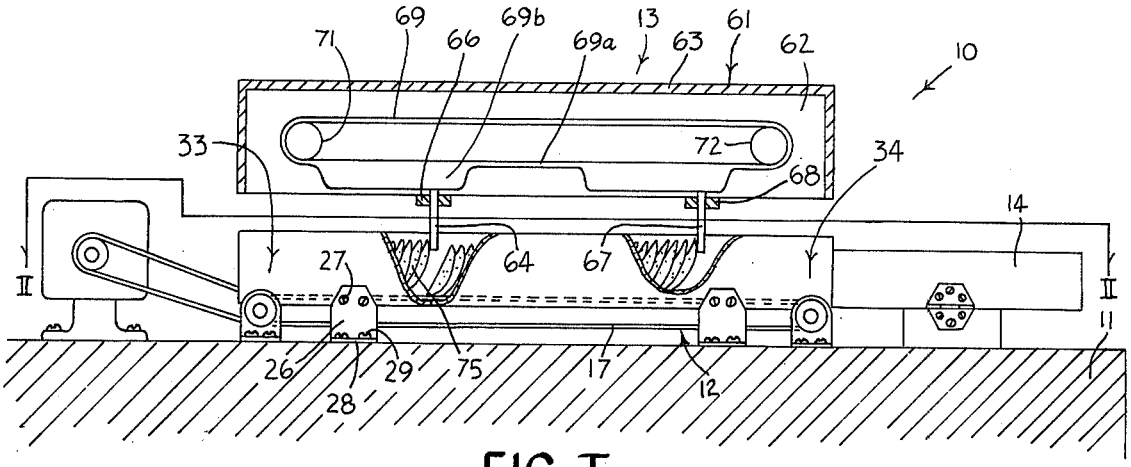
FIG. I
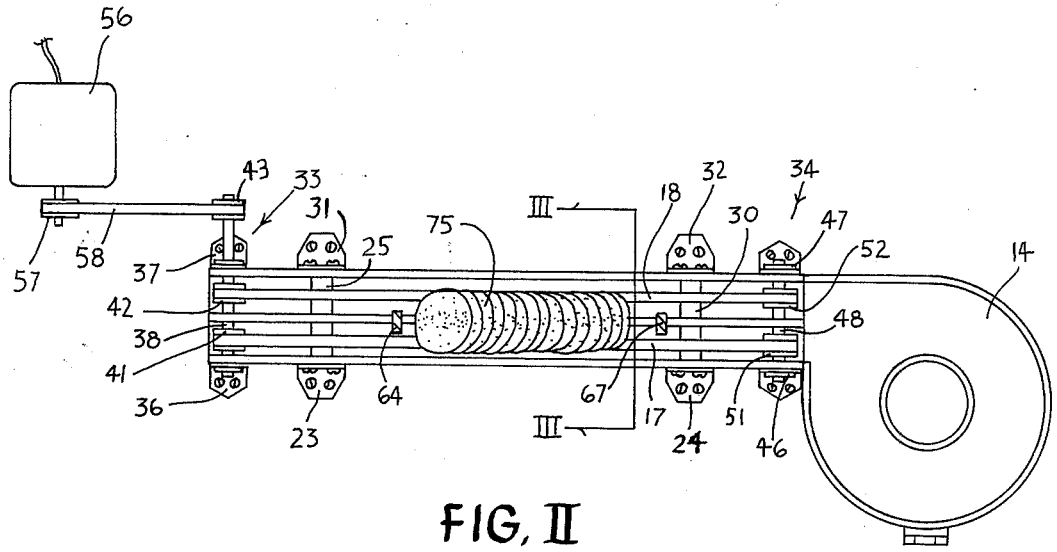
FIG. II

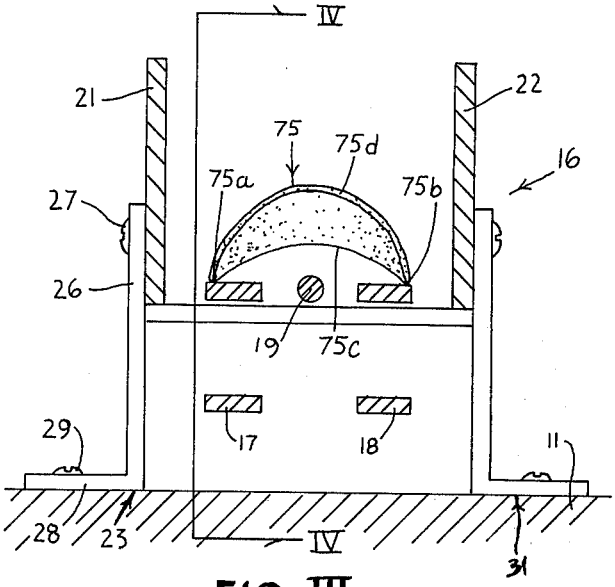
FIG. III
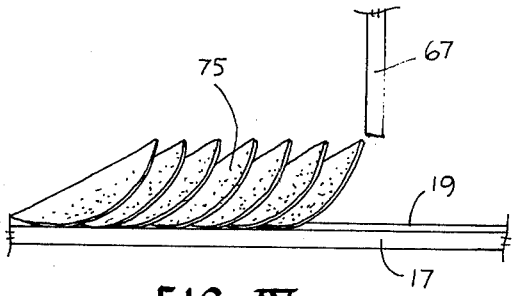
FIG. IV
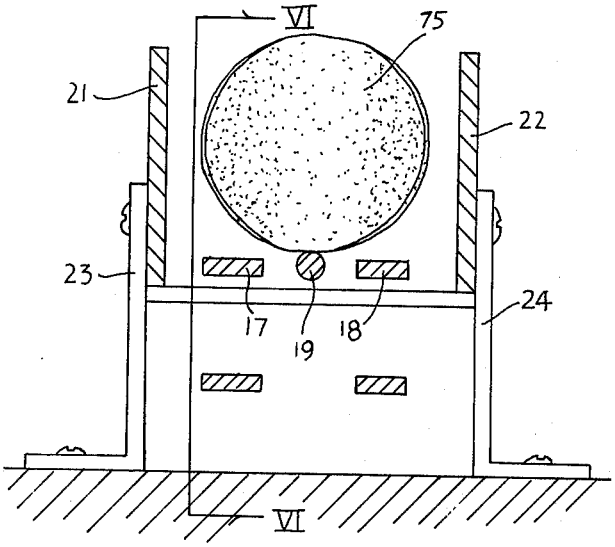
FIG. V
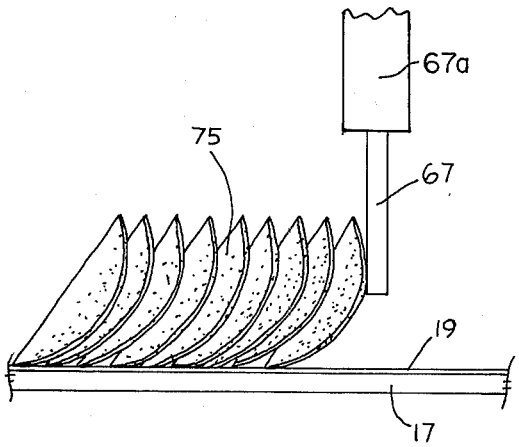
FIG. VI

APPARATUS FOR HANDLING SNACK CHIPS

BACKGROUND OF THE INVENTION

The present invention relates to apparatus for handling and packaging food products, and more particularly, to handling and packaging of chip-type food products.

A variety of types of handling and packaging equipment has been available in the past. Chip-type food products, for example, may be inserted into a bag in a random manner merely by dropping the chips through a chute directed into the bag. Such package-filling equipment is not suitable for packaging uniformly shaped, nested chips. Packaging of such nested chips may be carried out by hand; however, depositing of the uniformly shaped, nested chips in packages is particularly difficult and may be time consuming. One satisfactory apparatus for depositing of uniformly shaped, nested chips in a package is disclosed in commonly assigned U.S. Patent Application Ser. No. 616,749, filed Sept. 25, 1975 now U.S. Pat. No. 4,048,786. The present invention may be used in conjunction with the apparatus disclosed and claimed in such patent application.

The present invention provides apparatus for handling and segregating a column of nested chips. The segregated column may contain a predetermined number of chips, for example, the number needed to fill a container. Such column of nested chips may subsequently be fed into the loading reservoir described in U.S. Pat. No. 4,048,786. The present apparatus may be used for handling such snack chips as potato chips, wheat chips, rye chips, rice chips and the like.

In the drawings:

FIG. I shows a side view of one embodiment of the present invention with certain portions broken away;

FIG. II shows a top view of the present invention taken along the lines II—II in FIG. I;

FIG. III shows a cross sectional view of the present invention taken along the lines III—III in FIG. II;

FIG. IV shows a side view of a column of chips taken along the lines IV—IV in FIG. III;

FIG. V is a cross sectional view substantially like FIG. III except with the column of chips positioned differently;

FIG. VI shows a side view of the column of chips taken along the lines VI—VI in FIG. V.

DETAILED DESCRIPTION

The chip handling apparatus 10 of the present invention, one embodiment of which is shown in FIGS. I–VI, includes a support structure 11, a chip conveyor 12, and a column separator 13. The chip handling apparatus 10 of the present invention may be used in conjunction with a loading reservoir 14, substantially like that disclosed in U.S. Patent Application Ser. No. 616,749, the disclosure of which is incorporated herein by reference. Alternatively, the reservoir 14 may be replaced, for example, with a straight reservoir or simply with a container for reception of the column of chips.

The support structure 11 may comprise any suitable support such as a table and may, for example, be constructed of stainless steel stock.

The chip conveyor 12 (FIGS. I–III) may include a chute 16, a pair of continuous conveyor belts 17 and 18, as well as a chip support bar 19. The chip chute 16 serves to guide the column of chips in the desired direction, and may include a pair of side walls 21 and 22.

Wall 21 may be supported above table 11 by legs 23 and 24. For example, leg 23 may have a vertical flange 26 which is secured to wall 21 by a plurality of screws or bolts 27. Leg 23 may further include a horizontal flange 28 which is secured to table 11 by screws or bolts 29. Wall 22 may, in turn, be supported by legs 31 and 32. The legs 24, 31 and 32 may be constructed and secured to table 11 and walls 21 and 22 respectively, in a manner substantially identical to that described with regard to leg 23. The walls 21, 22 and the legs 23, 24, 31 and 32 desirably are constructed of stainless steel.

The continuous conveyor belts 17 and 18 may stretch substantially the full length of chip conveyor 12. The belts 17 and 18 are supported at their leftward ends (as seen in FIG. I) thereof by a pulley system 33 and at their rightward ends by a pulley system 34. Pulley system 33 includes a pair of hubs 36 and 37 (FIG. II) which support a shaft 38, for example, using suitable bearings. Hubs 36 and 37 may be secured to table 11 such as by screws or bolts. The shaft 38 has pulleys 41, 42 and 43 mounted thereon in locked engagement. Pulley 41 drivingly carries belt 17. Pulley 42 drivingly carries belt 18, and pulley 43 is for purposes hereinafter described. Pulley system 34 includes a pair of hubs 46 and 47 which rotatably support shaft 48 such as in suitable bearings. A pair of pulleys 51 and 52 are mounted on shaft 48 and in locked engagement therewith. Pulley 51 supports the rightward end of the belt 17 whereas pulley 52 supports the rightward end of the belt 18. Bar member 19 generally is supported substantially on the same plane as the upper reaches of belts 17 and 18 such as by cross members 25 and 30. However, in some instances, bar member 19 may be on a plane somewhat above or somewhat below belts 17 and 18.

The apparatus 10 may be powered by an electric motor 56 including a pulley 57 which drives belt 58. Belt 58 is in driving engagement with pulley 43.

The chip separating section 13 may be provided having gate members or flights substantially as disclosed in U.S. Pat. No. 2,650,010 which disclosure is incorporated herein by reference. A simplified version of such gate members is shown in FIG. I. The chip separating section 13 may include, for example, a housing 61 having side walls 62 and a top wall 63. Supported within the housing is a first gate 64 mounted in slide bearing 66 and a second gate 67 which is mounted in slide bearing 68. The gates 64 and 67 are mounted for reciprocating movement upwardly and downwardly and may be urged toward the upward most position by a spring (not shown). The slide bearing 66 and 68, as well as the springs may be suitably supported by the housing 61. A cam belt 69 may be rotatably supported on a pair of shafts and pulleys 71 and 72. The cam belt 69 drivingly engages the reciprocable gates 64 and 67. In other words, belt 69 has thin portions such as **69*a* which permit upward movement of the gates 64 and 67 and thickened portions 69*b* that drive gates 64 and 67 downwardly. Of course, various other driving means may be provided for gates 64 and 67, for example, hydraulic cylinders or pneumatic cylinders as shown by numeral 67*a*** in FIG. VI, or gear trains, might be used.

The bar 19 or an equivalent support is considered essential to the present invention. In absence of bar 19, the collumn of chips, when confronting gate 67, moves to a vertical position shown in FIGS. V and VI. However, the conveyor belts then continue to carry the lower edge of the chips forward until they fall over backwards approaching the horizontal position pointed in the opposite direction. Further, the continuing driving contact of the conveyor belts would tend to break or wear away the lower edge of the chips. The bar 19, however, may be replaced with other supports such as an intermittently driven belt which would halt during the time period that the chips are restrained.

OPERATION OF THE PRESENT INVENTION

Although operation of the present invention would be apparent from reading the aforedescription, it will be further detailed hereinafter. A column of chips 75 may be fed to apparatus 10 by any suitable means such as a conveyor system. When the chips are not restrained by gates 64 and/or 67, they lie in the substantially horizontal position shown in FIGS. III and IV. The side edges 75*a* and 75*b* engage the upper reach of belts 17 and 18 and are thereby transported. The rear edge 75*c* rises above bar 19 or gently touches bar 19.

The chip separating section 13 may be driven by any suitable means such as an electric motor (not shown); and when thin portion 69*a* of the belt is in contact with gate 67, such gate is in its uppermost position. As the belt 69 advances, thick portion 69*b* engages the gate 67 in a cam-like action and moves such gate downwardly, thereby blocking the path traversed by the column of chips 75. The chips then move to the vertical position shown in FIGS. V and VI and are supported by bar 19. Once the chips are in the substantially vertical position shown in FIG. VI, gate 64 may be similarly driven downwardly by belt 69; however, in this instance, gate 64 may be moved between a pair of adjacent chips thereby segregating the column 75 into 2 portions, one of which is of a predetermined size. The gate 67 may be withdrawn thereby permitting the forwardmost measured portion of chips to be carried into reservoir 14. Gate 64 may then be withdrawn permitting the incoming column 75 to move forward and the sequence to repeat.

The snack chips handled by the present apparatus may be curvilinear discs either planar or non-planar. In some instances the snack chips may be other than curvilinear so long as the chip is shaped such that the support of the chip may be shifted from the conveyor to the stationary support by blocking progress of the column of chips.

Various modifications of the present invention may be carried out without departing from the broader scope of the present invention. For example, the walls 21 and 22 may be replaced with any of various other guides such as a pair of rods or rails which serve to control the direction traversed by the chip column. In some instances the conveyor belts and/or the support bar may serve to control and assist in controlling the direction traversed by the chip column. The bar 19 may be a strap or a rod. Alternatively, there may be 2 rods disposed between the belts or rod 19 may be replaced with an intermittently driven belt. Also, the bar 19 may be positioned somewhat above the uppper reaches of belts 17 and 18, or alternatively, somewhat below such level. Other conveyor means may be used, for example, the conveyor belts 17 and 18 may be replaced with vibrating straps or bars. Various other modifications may be made.

The embodiments of the invention in which an exclusive property or privilege is claimed are defined as follows:

1. Apparatus for handling a column of uniformly shaped, nested, individual curvilinear snack chips, said apparatus comprising:

conveyor means including a pair of substantially parallel side wall means, a pair of parallel, spaced elongated conveying surfaces disposed between and in alignment with said pair of wall means, and elongated stationary support means disposed between said pair of belt means; and shifting means for acting on said column of individual chips to shift the support of said column from said conveyor belt means to said stationary support means and from said stationary support means to said conveyor belt means, said shifting means comprising gate means and reciprocable driving means for moving said gate means into and out of the conveying path traversed by said column of chips, whereby said gate means is moved into said path to change the orientation of said individual chips from a position approaching but greater than horizontal to a position approaching but less than vertical thereby shifting the support of said column from said pair of belt means to said stationary support means and whereby said gate means is moved out of said path to permit the individual chips to return to a position approaching horizontal.

2. The apparatus of claim 1 wherein said conveying surfaces include spaced conveyor belt means.

3. The apparatus of claim 1 wherein said elongated stationary support means comprise bar means.

4. The apparatus of claim 1 wherein said reciprocable gate driving means comprise cam means.

5. The apparatus of claim 1 wherein said reciprocable gate driving means comprise pneumatic cylinder means.

6. The apparatus of claim 1 wherein said reciprocable gate driving means comprise hydraulic cylinder means.

7. The apparatus of claim 1 wherein said apparatus further includes means for segregating said chip column into at least two separated column portions.

8. The apparatus of claim 1 wherein said segregating means comprises second gate means and reciprocable driving means for moving said segregating gate means between a pair of nested chips.

* * * * *